US008252074B2

(12) United States Patent
Van Dyk et al.

(10) Patent No.: US 8,252,074 B2
(45) Date of Patent: Aug. 28, 2012

(54) METHOD OF OPERATING A FIXED BED DRY BOTTOM GASIFIER

(75) Inventors: Johannes Christoffel Van Dyk, Sasolburg (ZA); Margaretha Coertzen, Vanderbijlpark (ZA)

(73) Assignee: Sasol-Lurgi Technology Company (Proprietary) Limited, Johannesburg (ZA)

( * ) Notice: Subject to any disclaimer, the term of this patent is extended or adjusted under 35 U.S.C. 154(b) by 1194 days.

(21) Appl. No.: 11/814,721

(22) PCT Filed: Jan. 26, 2006

(86) PCT No.: PCT/IB2006/050277

§ 371 (c)(1),
(2), (4) Date: Jul. 25, 2007

(87) PCT Pub. No.: WO2006/082543

PCT Pub. Date: Aug. 10, 2006

(65) Prior Publication Data

US 2008/0134581 A1 Jun. 12, 2008

(30) Foreign Application Priority Data

Feb. 1, 2005 (ZA) ..... 2005/0924

(51) Int. Cl.
*C10L 3/00* (2006.01)

(52) U.S. Cl. ..... 48/210; 48/197 FM

(58) Field of Classification Search ..... 48/197 R–197 A
See application file for complete search history.

(56) References Cited

U.S. PATENT DOCUMENTS

| | | | | |
|---|---|---|---|---|
| 3,811,849 | A | 5/1974 | Woodmansee | |
| 3,912,465 | A * | 10/1975 | Kunii et al. | 48/101 |
| 4,309,198 | A * | 1/1982 | Moss | 48/197 R |
| 4,439,210 | A | 3/1984 | Lancet | |
| 4,441,892 | A * | 4/1984 | Schuster | 48/197 R |
| 4,655,792 | A * | 4/1987 | Kessler et al. | 48/197 R |
| 4,657,698 | A * | 4/1987 | Najjar et al. | 252/373 |
| 4,705,536 | A * | 11/1987 | Becker et al. | 48/197 R |
| 4,705,538 | A * | 11/1987 | Najjar et al. | 48/197 R |
| 4,705,539 | A * | 11/1987 | Najjar et al. | 252/373 |
| 4,801,402 | A * | 1/1989 | Najjar et al. | 252/373 |
| 4,889,658 | A * | 12/1989 | Najjar | 48/197 R |

(Continued)

FOREIGN PATENT DOCUMENTS

BE 563 454 1/1958

(Continued)

OTHER PUBLICATIONS

Machine Translation of EP1371714A2.*

(Continued)

*Primary Examiner* — Imran Akram
(74) *Attorney, Agent, or Firm* — Fitch, Even, Tabin & Flannery, LLP

(57) ABSTRACT

Method of operating a fixed bed dry bottom gasifier includes feeding coarse particulate coal with an average particle size of at least 1 mm and an ash fusion temperature increasing agent into a gasification chamber of the gasifier to form a coal bed, feeding a gasification agent into the gasification chamber, and gasifying the coarse particulate coal in the gasification chamber to produce synthesis gas as well as ash. The ash is collected in an ash bed below the coal, and the synthesis gas and the ash are removed from the gasification chamber.

7 Claims, 3 Drawing Sheets

U.S. PATENT DOCUMENTS

| | | | | |
|---|---|---|---|---|
| 4,936,047 | A * | 6/1990 | Feldmann et al. | 48/197 R |
| 5,356,540 | A * | 10/1994 | Khan et al. | 210/758 |
| 5,656,042 | A * | 8/1997 | Khan et al. | 48/197 R |
| 6,149,765 | A * | 11/2000 | Mansour et al. | 162/29 |
| 6,615,751 | B1 | 9/2003 | Sorensen et al. | |
| 2002/0095866 | A1 * | 7/2002 | Hassett | 48/199 FM |

FOREIGN PATENT DOCUMENTS

| | | | |
|---|---|---|---|
| BE | 563 454 | A | 1/1958 |
| EP | 1 217 063 | A2 | 6/2002 |
| EP | 1 371 714 | A | 12/2003 |
| EP | 1 371 714 | A2 | 12/2003 |
| GB | 1 597 691 | | 9/1981 |
| GB | 1 597 691 | A | 9/1981 |

OTHER PUBLICATIONS

Machine Translation of EP1371714A1, Dec. 17, 2003.*

* cited by examiner

METHOD OF OPERATING A FIXED BED DRY BOTTOM GASIFIER

CROSS REFERENCE TO RELATED APPLICATIONS

This application is a 35 U.S.C 371 application of International Application No PCT/IB2006/050277 filed Jan. 26, 2006, claiming priority from ZA 2005/0924 filed Feb. 1, 2005.

This INVENTION relates to a method of operating a fixed bed dry bottom gasifier.

BACKGROUND OF THE INVENTION

It is well known to add additives, e.g. calcium compounds, to carbonaceous material being gasified in a slagging gasifier thereby to decrease the ash fusion temperature. However, in the case of fixed bed dry bottom gasifiers such as the Sasol-Lurgi fixed bed dry bottom gasifier, the slagging of ash is undesired as it leads to unstable operation or inoperability of the gasifier. A fixed bed dry bottom gasifier must thus be operated in a temperature region such that the maximum gasifier temperature is below the ash fusion temperature of the carbonaceous material which is being gasified. Conventionally, this is achieved by decreasing the oxygen load into the gasifier or by operating the gasifier with an excess of steam as gasification or moderating agent. Decreasing the oxygen load into the gasifier is undesirable as it results in a direct reduction in synthesis gas production. Operating the gasifier with an excess of steam is also not ideal as it results in decreased thermal efficiency of the gasification process as more energy is required to generate the excess steam.

Fixed bed dry bottom gasifiers such as the Sasol-Lurgi fixed bed dry bottom gasifiers are also known as moving bed dry ash gasifiers.

SUMMARY

According to the invention, there is provided a method of operating a fixed bed dry bottom gasifier, the method including feeding coarse particulate carbonaceous material with an average particle size of at least 1 mm and an ash fusion temperature increasing agent into a gasification chamber of the gasifier to form a carbonaceous material bed;

feeding a gasification agent into the gasification chamber;

gasifying the coarse particulate carbonaceous material in the gasification chamber to produce synthesis gas as well as ash, the ash being collected in an ash bed below the carbonaceous material; and removing the synthesis gas and the ash from the gasification chamber.

Typically, the coarse particulate material and the ash fusion temperature increasing agent are fed into the gasification chamber through a lock located above the carbonaceous material bed, e.g. a coal lock.

Typically, the ash is withdrawn in a dry coarse form through an ash lock which is in communication with the gasification chamber via an ash discharge outlet in a bottom of the gasification chamber.

The gasifier typically includes a coarse particulate carbonaceous material distribution device which also defines a gas collection zone, with the synthesis gas thus being withdrawn from the gas collection zone.

Preferably, the carbonaceous material bed is a homogenously mixed bed comprising the coarse particulate carbonaceous material and the ash fusion temperature increasing agent.

Preferably, the coarse particulate carbonaceous material has an average particle size of at least 3 mm, preferably at least 4 mm, or even more coarse.

The particulate carbonaceous material is preferably coal.

The ash fusion temperature increasing agent may be a solid material or a solution, although the applicant expects that a solid material will be preferable. In this case, the particulate carbonaceous material and the solid ash fusion temperature increasing agent will typically be in the form of a simple admixture, i.e. not pelletized or the like but a mixture of individual non-homogenised solid particles.

It may be possible to achieve the required increase in ash fusion temperature even at relatively low levels of ash fusion temperature increasing agent. The ash fusion temperature increasing agent may thus be fed in an amount of less than 5% by mass, preferably less than 4% by mass, more preferably less than 3% by mass, typically between about 1% by mass and about 2% by mass of the ash formed in the gasification chamber.

The ash fusion temperature increasing agent may be a substance capable of reacting with one or more compounds of calcium, magnesium, iron, potassium, silicon or sodium at elevated temperatures to form products melting at higher temperatures than the compounds of these elements present in the coarse particulate carbonaceous material. The ash fusion temperature increasing agent may thus be an acidic agent and may in particular be kaolinite ($Al_2Si_2O_5(OH)_4$), alumina ($Al_2O_3$), silica ($SiO_2$) or $TiO_2$, most preferably alumina ($Al_2O_3$).

When the coarse particulate carbonaceous material is particulate coal, the coal may be gasified at a temperature above the ash fusion temperature of the coal. The gasification temperature may be at least 1330° C., more preferably at least 1345° C., even more preferably at least 1360° C., most preferably at least 1375° C. or even 1400° C., but below the ash fusion temperature of an admixture of the particulate coal and the ash fusion temperature increasing agent.

When the particulate carbonaceous material is particulate coal, the synthesis gas may have an $H_2/CO$ mole ratio of less than 1.65, preferably less than 1.60, more preferably less than 1.50.

BRIEF DESCRIPTION OF THE DRAWINGS

The invention will now be described, by way of example, with reference to the accompanying diagrammatic drawings.

In the drawings.

DETAILED DESCRIPTION

Figure 1:
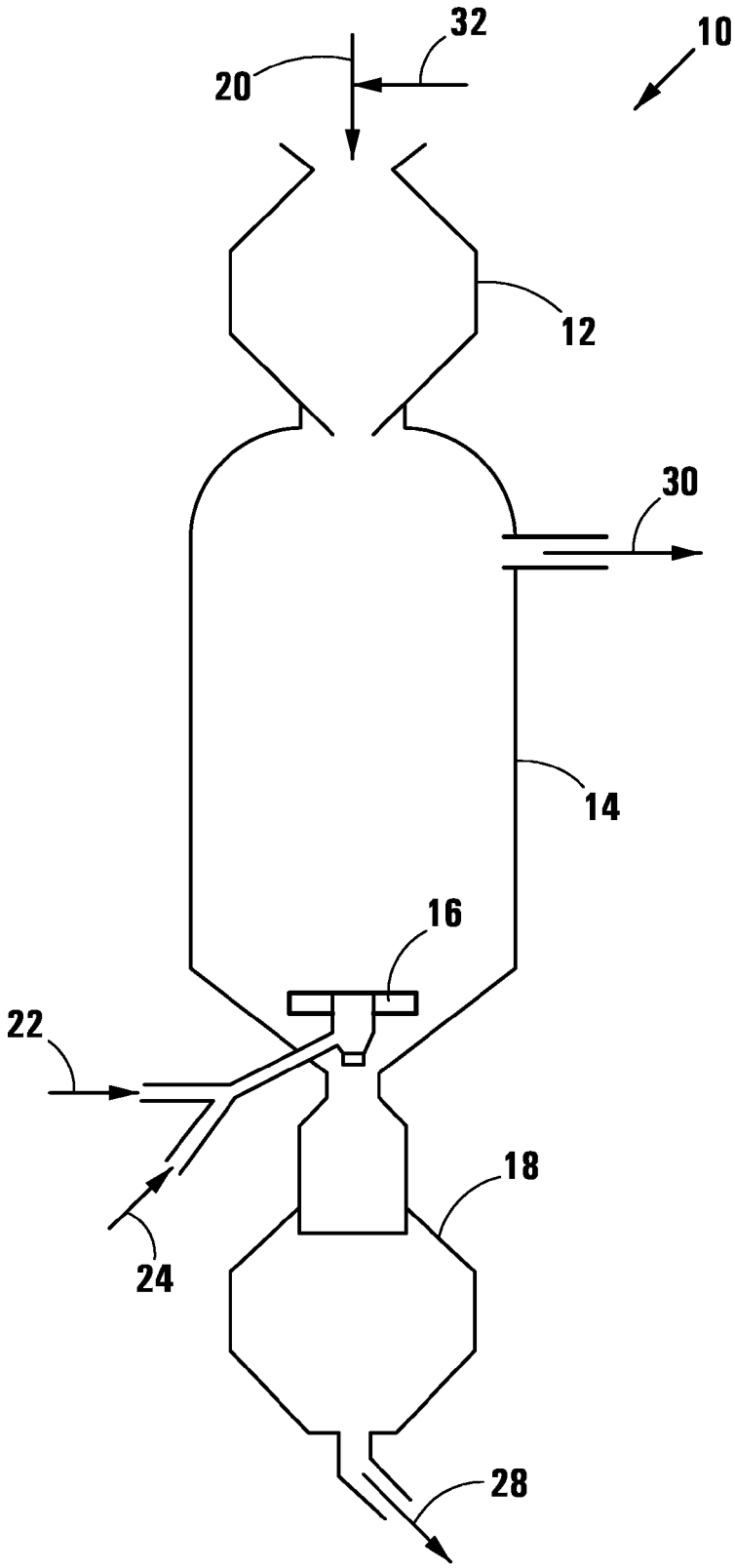
FIG. 1 shows a schematic diagram of a fixed bed dry bottom gasifier.

Referring to FIG. 1 of the drawings, reference numeral 10 generally indicates a fixed bed dry bottom gasifier such as a Sasol-Lurgi gasifer. The gasifier 10 includes a coal lock 12, a gasification reactor 14, a rotating grate 16 and an ash lock 18. The gasifier 10 is a pressurised gasifier.

In use, a sized coal feed 20 with particles greater than 4 mm enters the gasification reactor 14 through the coal lock 12 and moves down through a bed formed inside the gasification reactor 14. An oxygen feed 22 and a steam feed 24 enter at a bottom of the bed, through the grate 16. Oxygen is required to combust some of the coal to supply energy for the endothermic gasification reactions. Typically, part of the steam that is used is generated in a gasifier jacket (not shown) from boiler feed water that is fed to the jacket. The steam has a pressure of 40 bar (gauge) and a temperature of about 390° C., with the boiler feed water being at a pressure of about 40 bar (gauge) and a temperature of about 105° C. and the oxygen being at a pressure of about 29 bar (gauge) and a temperature of about 140° C.

Within the gasifier bed, different reaction zones are distinguishable from top to bottom, namely a drying zone where moisture is released, a devolatization zone where pyrolysis takes place, a reduction zone or gasification zone where mainly endothermic reactions occur, an exothermic oxidation or combustion zone, and an ash bed at the bottom of the gasifier bed. As a result of the counter-current mode of operation, hot ash exchanges heat with cold incoming reagents, such as steam and oxygen or air, while at the same time hot raw gas exchanges heat with cold incoming coal. This results in an ash stream 28 and a raw gas stream 30, respectively leaving the gasifier 10 from the ash lock 18 and the gasification reactor 14, at relatively low temperatures compared to other types of gasifiers, which improves the thermal efficiency and lowers the steam and oxygen consumption of the gasifier. The ash passes through the rotating grate 16 and the ash lock 18 before being removed.

In the pyrolysis zone of the gasifier, tars, oils and pitches and the like are released. These pyrolysis products are not destroyed, in view of the relatively low operating temperature of the pressurised dry ash moving bed gasifier 10. The pyrolysis products can be used to create valuable co-products such as ammonia, sulphur, cresols and phenols.

The following are some of the reactions that take place in the gasifier:

Combustion:

$$C+O_2 \rightarrow CO_2 \Delta H=-406 \text{ kJ/mol}$$

Reduction:

$$C+CO_2 \rightarrow 2CO \Delta H=160 \text{ kJ/mol}$$

$$C+H_2O \rightarrow CO+H_2 \Delta H=119 \text{ kJ/mol}$$

Water-Gas Shift:

$$CO+H_2O \rightarrow CO_2+H_2 \Delta H=-40 \text{ kJ/mol}$$

Methane Formation:

$$C+2H_2 \rightarrow CH_4 \Delta H=-87 \text{ kJ/mol}$$

$$CO+3H_2 \rightarrow CH_4+H_2O \Delta H=-206 \text{ kJ/mol}$$

$$3C+2H_2O \rightarrow CH_4+2CO \Delta H=182 \text{ kJ/mol}$$

The temperature profile in the gasifier 10 varies between about 800° C. and 1200° C. as the coal moves through the different zones in the gasification reactor 14. The raw gas stream 30 leaves the gasification reactor 14 typically at a temperature of between about 460° C. and 500° C., but may be lower.

The maximum temperature in the gasifier 10 is limited by the ash fusion temperature of the coal feed 20 as ash fusion creates removal problems of the ash at the bottom of the gasifier 10. Owing to this limitation, the temperatures can conventionally not be raised, causing more methane to form part of the raw synthesis gas than would be the case with higher temperatures. Conventionally, sufficient steam is fed to the bottom of the gasification reactor 14 to keep the temperature below the melting temperature of the ash.

In accordance with the invention, an ash fusion temperature increasing agent is fed into the gasifier 10 thereby to raise the ash fusion temperature of the coal ash bed. A possible inlet location for the ash fusion temperature increasing agent is indicated by reference numeral 32. Thus, it is expected that the coarse particulate coal and the ash fusion temperature increasing agent will be fed into the gasification reactor 14 through the coal lock 12. A coal distributor (not shown) which is typically located below the coal lock 12 ensures that the coal and ash fusion temperature increasing agent are distributed in a well mixed manner in the gasification reactor 14.

Figure 2:
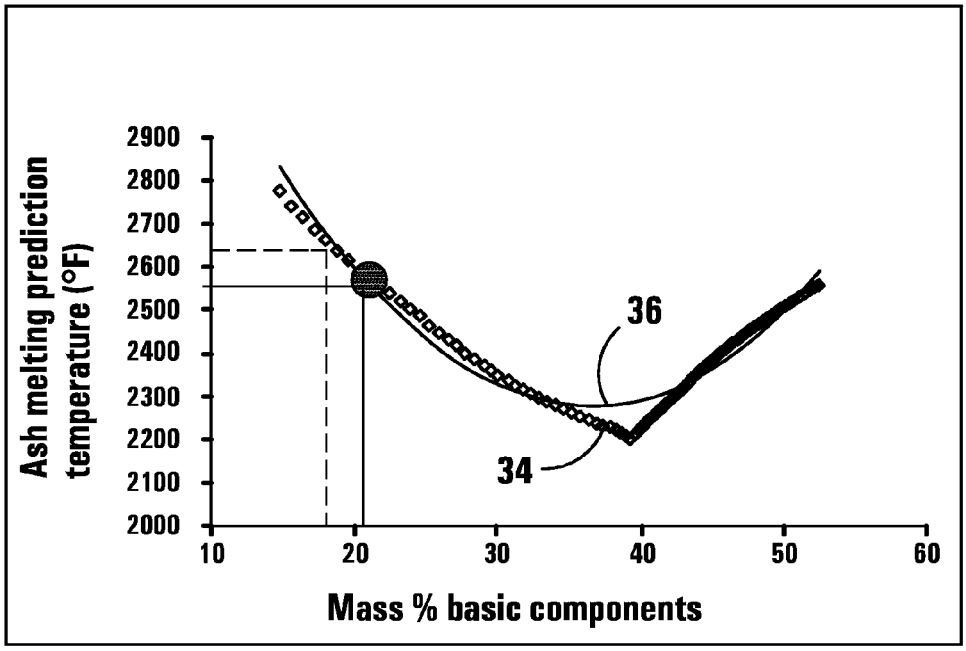
FIG. 2 shows a graph of a typical ash melting prediction curve.

FIG. 2 shows a typical ash melting prediction curve 34. Curves such as the curve 34 can be used to obtain a qualitative indication of the decrease in the percentage basic (calcium, magnesium, iron, potassium and sodium) components in the ash needed to effect a required increase in the ash fusion temperature. The calculated decrease in the percentage basic components is achieved by the addition of an acidic ash fusion temperature increasing agent. When viewed from this perspective, the effect of an ash fusion temperature increasing agent here is believed to be a physical diluting effect.

The ash melting prediction curve 34 in FIG. 2 is fairly accurately modelled by the following formula:

$$\text{Ash fusion temperature (° F.)}=1.1914x^2-87.066x+3867$$

where x is the mass % basic components (calcium, magnesium, iron, potassium and sodium) in the ash. The ash fusion temperature as a function of x is shown by the graph 36.

For the particular coal feed used to prepare the ash melting prediction curve shown in FIG. 2, it is thus possible to calculate that for an increase in the ash fusion temperature of 37° C. to above 1350° C., the amount of acidic component (e.g. kaolinite) in the ash needs to be increased by 1.9 mass %. It is then a simple calculation to determine how much of the ash fusion temperature increasing agent to add to the coal feed 20.

Figure 3:
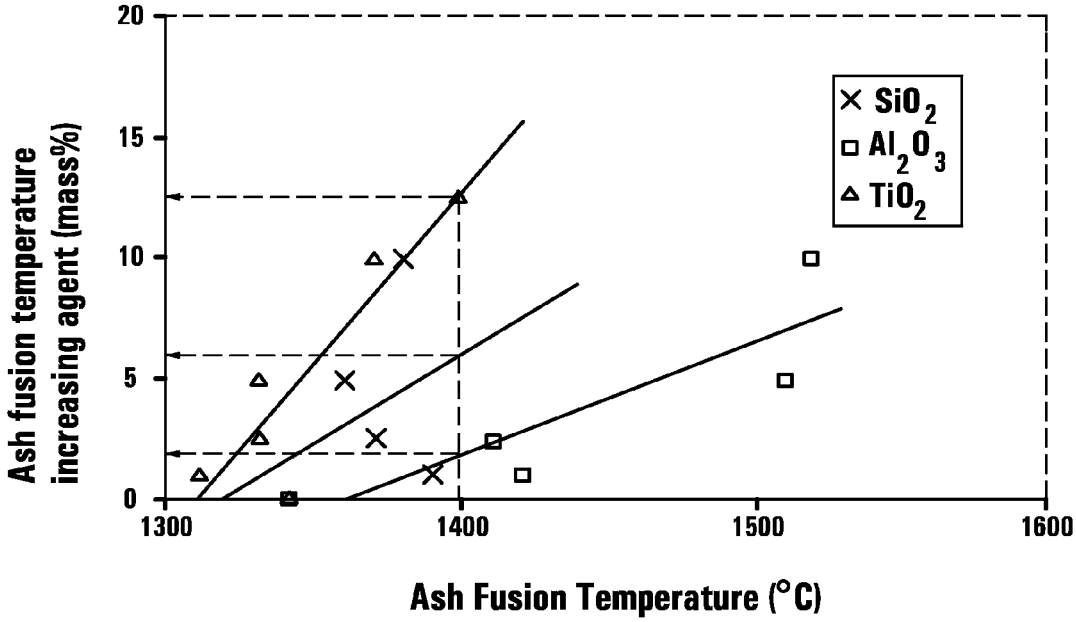
FIG. 3 shows a graph of experimental ash fusion temperature measurements with various acidic ash fusion temperature increasing agents.

With reference to FIG. 3, some experimental ash fusion temperature measurements with various acidic ash fusion temperature increasing agents are shown. As can be seen in FIG. 3, when using alumina as ash fusion temperature increasing agent, fairly small amounts are required to obtain significant increases in the ash fusion temperature.

While not wishing to be bound by theory, the applicant believes that some of the observed effects can be explained by considering the reactive chemical species and thermodynamic equilibria present. Consideration is here given to the role of kaolinite ($(Al_2O_3)(SiO_2)_2(H_2O)_2$), $SiO_2$ and $Al_2O_3$ in the formation of mullite ($(Al_6O_5(SiO_4)_2)$). Mullite is a high temperature melting mineral and its formation is believed to cause the ash fusion temperature of the ash mixture to increase, resulting in the formation of less slag-liquid.

The mechanistic formation of mullite from kaolinite is believed to take place via a metastable phase called metakaolinite. Kaolinite decomposes to metakaolinite around 450° C. to 800° C. with the formation of mullite from temperatures above 850° C., specifically for temperatures above 1100° C. The amount of mullite that can be formed is thus directly correlated with the amount of kaolinite present in the coal sample.

Free $SiO_2$ is typically naturally present in coal and reacts with basic components to form relatively low melting minerals when compared to mullite. Mullite formation is believed to be possible when free $Al_2O_3$ in the coal is available that can react with the free $SiO_2$ present in the coal. However, free $Al_2O_3$ is normally not present in coal.

With the addition of $Al_2O_3$, typically $\gamma$-$Al_2O_3$, it is believed that the free $SiO_2$ in the coal then reacts with the added $Al_2O_3$ to form mullite directly. The added $Al_2O_3$ acts as a network former for the reaction of $SiO_2$ to form mullite.

It is thus believed that free $SiO_2$, naturally present in coal, and free $Al_2O_3$, not naturally present in coal, aid in increasing the ash fusion temperature by two possible mechanisms. Firstly, there is a physical effect in which free $SiO_2$ may act as a diluting agent that helps to form less slag. This mechanism is illustrated in FIG. 2 and the accompanying discussion. A second mechanism potentially becomes relevant when $Al_2O_3$ is added as free $Al_2O_3$ and chemically reacts with the free $SiO_2$ to form mullite species with a high ash fusion temperature.

Figure 4:
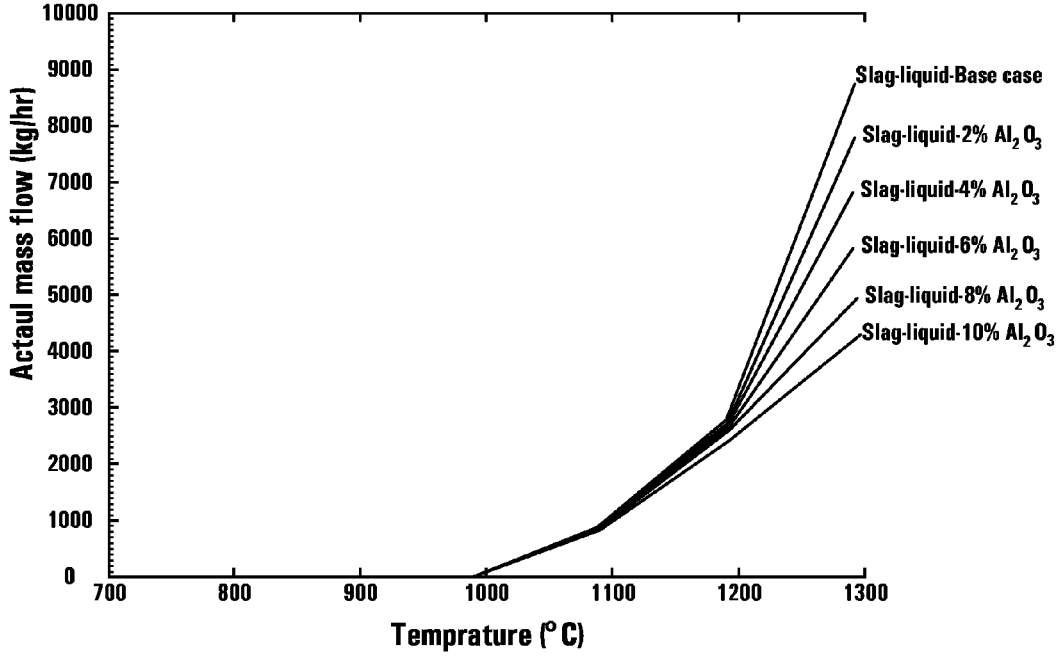
FIG. 4 shows a graph of a computer simulated prediction of the decrease in slag-liquid formation with the addition of y-$Al_2O_3$ in the gasification zone of a fixed bed dry bottom gasifier.
Figure 5:
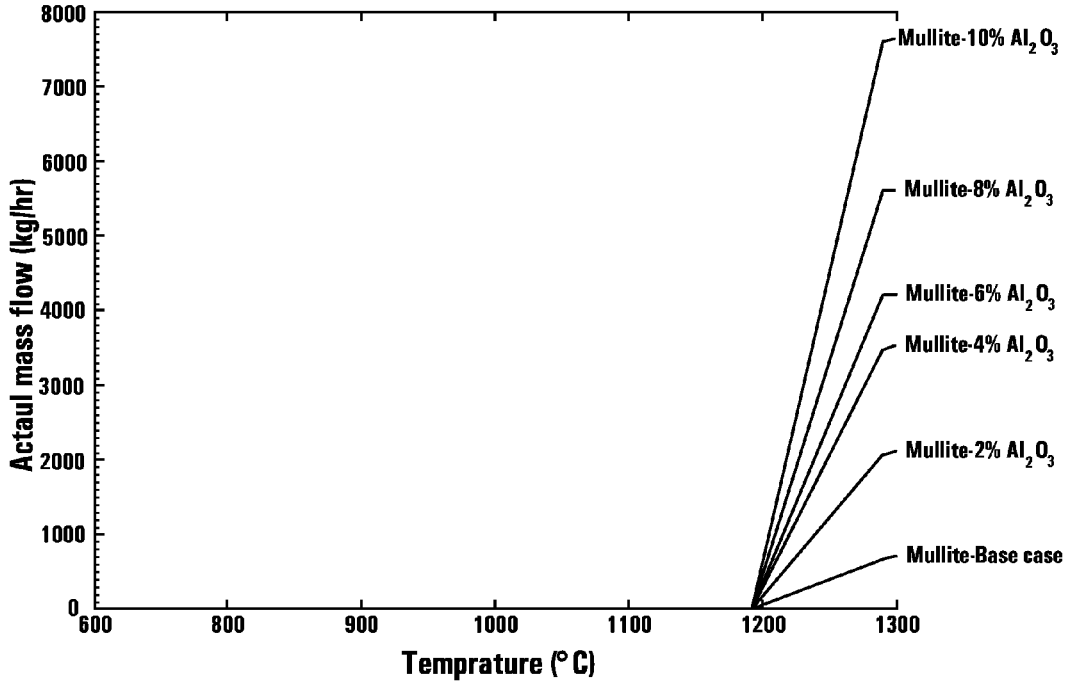
FIG. 5 shows a graph of a computer simulated prediction of the formation of mullite with the addition of y-$Al_2O_3$ in the gasification zone of a fixed bed dry bottom gasifier.

The above chemistry and its physical effect were simulated using a computer simulation of the gasification zone of a gasifier. The results are presented in FIGS. 4 and 5. FIG. 4 illustrates the decrease in slag-liquid formation with increasing y-$Al_2O_3$ addition to the gasifier as a function of temperature. FIG. 5 shows the increasing formation of mullite with increasing y-$Al_2O_3$ addition to the gasifier as a function of temperature.

The results in FIGS. 4 and 5 seem to indicate that the beneficial effect of $\gamma$-$Al_2O_3$ addition becomes relevant at temperatures greater than 1100° C., with the most significant effect at temperatures greater than 1200° C. This temperature region advantageously corresponds to the preferred operating region for fixed bed dry bottom gasifiers of around 1330° C.

A computer simulation of a gasifier similar to the gasifier 10 was used to obtain a prediction of the improvement in gasifier thermal efficiency with increasing maximum gasifier operating temperature. The results were calculated at constant gasifier load and coal feed. Excess steam is fed to the gasifier to control the maximum gasifier operating temperature and the increased thermal efficiency is thus reflected in a decreased high pressure (HP) steam consumption. The following table shows the calculated results:

| Gasifier operating temperature | Percentage decrease in HP steam consumption | $H_2$/CO ratio (mole | Raw gas composition (mole fractions) | | | |
|---|---|---|---|---|---|---|
| (° C.) | (%) | fractions) | $H_2$ | $CH_4$ | CO | $CO_2$ |
| 1325 | 0 | 1.71 | 0.382 | 0.089 | 0.223 | 0.288 |
| 1343 | 4 | 1.65 | 0.379 | 0.089 | 0.23 | 0.284 |
| 1355 | 6.3 | 1.61 | 0.378 | 0.089 | 0.235 | 0.281 |

-continued

| Gasifier operating temperature | Percentage decrease in HP steam consumption | $H_2$/CO ratio (mole | Raw gas composition (mole fractions) | | | |
|---|---|---|---|---|---|---|
| (° C.) | (%) | fractions) | $H_2$ | $CH_4$ | CO | $CO_2$ |
| 1366 | 9.5 | 1.57 | 0.376 | 0.089 | 0.24 | 0.278 |
| 1416 | 18 | 1.41 | 0.367 | 0.089 | 0.261 | 0.265 |

As will be noted, the $H_2$/CO molar ratio decreases with increasing maximum gasifier operating temperature. Advantageously, as a result of being able to increase the maximum gasifier operating temperature, it is possible to match the $H_2$/CO ratio in the gasifier outlet to the needs of a downstream process which possibly also provides one with the opportunity of de-bottlenecking the downstream process.

The invention claimed is:

1. A method of operating a gasifier, the method including:

mixing coarse particulate coal with an average particle size of at least 1 mm and an ash fusion temperature increasing agent to form a mixture and feeding said mixture into a gasification chamber of the gasifier to form a coal bed with a raised ash fusion temperature;

feeding oxygen and steam into the gasification chamber;

gasifying the coarse particulate coal in the gasification chamber to produce synthesis gas as well as ash and collecting the ash in an ash bed below the coal; and removing the synthesis gas and the ash from the gasification chamber;

wherein the ash fusion temperature increasing agent is kaolinite ($Al_2Si_2O_5(OH)_4$), alumina $Al_2O_3$), silica ($SiO_2$), or titania ($TiO_2$);

wherein the gasifier is a fixed bed dry bottom gasifier.

2. The method as claimed in claim 1, in which the coal bed is a homogenously mixed bed comprising the coarse particulate coal and the ash fusion temperature increasing agent, the coarse particulate coal having an average particle size of at least 3 mm.

3. The method as claimed in claim 1, in which the course particulate coal with an average particle size of at least 4 mm.

4. The method as claimed in claim 1, in which the ash fusion temperature increasing agent is alumina ($Al_2O_3$).

5. The method as claimed in claim 1, in which the coarse particulate coal and the ash fusion temperature increasing agent fed in the gasifier form an admixture with an ash fusion temperature in excess of 1330° C., and in which the coarse particulate coal is gasified at a temperature of at least 1330° C., but below the ash fusion temperature of the admixture of the particulate coal and the ash fusion temperature increasing agent.

6. The method as claimed in claim 5, in which said admixture has an ash fusion temperature in excess of 1345° C. and in which coal is gasified at a temperature of at least 1345° C. but below the ash fusion temperature of said admixture.

7. The method as claimed in claim 1, in which the synthesis gas has an $H_2$/CO mole ratio of less than 1.65.

* * * * *